US005522642A

United States Patent [19]

Herzog

[11] Patent Number: 5,522,642

[45] Date of Patent: Jun. 4, 1996

[54] FOLDING SEATING WITH SELECTIVELY EXTENDABLE LEGS

[76] Inventor: William E. Herzog, 600 S. Riverside Rd., St. Joseph, Mo. 64052

[21] Appl. No.: 387,483

[22] Filed: Feb. 13, 1995

[51] Int. Cl.[6] ..... A47C 3/20

[52] U.S. Cl. ..... 297/344.18; 248/180.5; 248/188.2; 403/109; 403/378

[58] Field of Search ..... 297/344.18; 248/188.5, 248/188.2, 354.5; 403/150, 109, 377, 378, 154, 379; 16/115

[56] References Cited

U.S. PATENT DOCUMENTS

| | | | |
|---|---|---|---|
| 1,152,987 | 9/1915 | Spalding | 248/188.5 |
| 2,675,256 | 4/1954 | Cornell | 248/188.5 |
| 3,177,035 | 4/1965 | Halstrick | 248/188.2 |
| 4,029,278 | 6/1977 | Napoleon | 248/188.2 |
| 4,752,057 | 6/1988 | Hagemes | 248/354.5 |
| 4,790,416 | 12/1988 | Baker | 248/188.5 |
| 4,934,638 | 6/1990 | Davis | 248/188.5 |
| 5,259,821 | 11/1993 | Bryant | 403/378 |

FOREIGN PATENT DOCUMENTS

| | | | |
|---|---|---|---|
| 1429913 | 1/1966 | France | 248/354.6 |

*Primary Examiner*—Peter R. Brown
*Assistant Examiner*—Anthony D. Barfield
*Attorney, Agent, or Firm*—Litman, McMahon and Brown

[57] ABSTRACT

A folding stool is provided which includes a pair of leg assemblies each having a leg base frame comprising a pair of leg members integrally connected to a crosspiece. The leg base frames are pivotally interconnected for folding the stool to a folded configuration thereof. A plurality of leg extensions are provided and each is length-adjustably telescopically received in a respective leg member and is selectively secured in fixed relationship therewith by a respective locking pin. A flexible seat extends transversely between the crosspieces and includes passages at ends thereof for receiving the leg base frame crosspieces.

2 Claims, 1 Drawing Sheet

FOLDING SEATING WITH SELECTIVELY EXTENDABLE LEGS

BACKGROUND OF THE INVENTION

1. Field of the Invention

The present invention relates generally to seating equipment and devices, and in particular to a folding stool with adjustable length legs.

2. Description of the Related Art

Various types of seating equipment and devices have heretofore been employed to meet the requirements of particular seating applications. Such seating can range from expensive and elaborate fixtures, which are permanently installed, to inexpensive, portable seating units which are intended for personal use and can easily be folded and transported.

Portable folding seating is well known and outdoor pieces are often referred to as "lawn furniture". For example, folding stools have previously been provided which include metal tubing frames with fabric seats supported thereon. In a common type of folding stool, the frames can be folded with respect to each other with the seat folded therebetween whereby the stool is placed in a folded configuration. Such stools tend to have the advantages of being relatively lightweight, easy to transport and inexpensive. However, a disadvantage relates to their lack of adaptability to sloping and uneven support surfaces. Such surfaces are often encountered outdoors, for example, at sporting events and the like where permanent seating is not provided.

Spectators at various outdoor sporting events and participants in outdoor activities often bring their own seating, which can range from simple ground covers to more elaborate equipment. Folding stools and chairs are often used by spectators at outdoor sporting and other participants at outdoor activities. Such folding seating is commonly available which is relatively lightweight and inexpensive, and thus well suited for being easily transported from one location to another, for instance by golf tournament spectators and other participants in outdoor sporting events. However, at each different outdoor location, different topography and surface conditions may be encountered which would tend to pitch the seat of a conventional folding chair or stool at an awkward or uncomfortable angle.

Another problem with previous types of outdoor seating relates to the fixed-height position of the seating. Thus, the view of a person sitting at, for example, the back of a crowd might be blocked by other spectators in front of him or her, particularly if all of the spectators were using seating of a similar height.

The present invention addresses the need for seating which is adaptable to various topographical conditions. Heretofore there has not been available folding seating with the advantages and features of the present invention.

SUMMARY OF THE INVENTION

In the practice of the present invention, a folding stool is provided which includes a pair of leg assemblies each having a leg base frame comprising a pair of leg members interconnected at their upper ends by a crosspiece. Leg extensions are telescopically received in the leg member lower ends and are secured with respect thereto by locking pins which selectively extend through aligned receivers in the leg members and the leg extensions. The leg assemblies thus form independently length-adjustable legs by the cooperation between the leg members and the leg extensions for providing a generally level seat on terrain with various sloping configurations.

OBJECTS AND ADVANTAGES OF THE INVENTION

The principle objects and advantages of the present invention include: providing folding seating with selectively extendable legs; providing such seating which is adaptable for use on various ground and topographical conditions; providing such seating which is foldable between use and folded configurations; providing such seating which is relatively lightweight and easily transportable; providing such seating which can fold to a relatively flat configuration; providing such seating which can be fabricated from common materials used for folding seating; providing such seating with legs which can be independently extended; providing such seating with a length-adjusting system for the legs which is relatively simple and efficient in operation; providing such seating with a length-adjusting system for the legs which allows the seat height to be raised and lowered; providing such seating which is economical to manufacture, efficient in operation and particularly well-adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
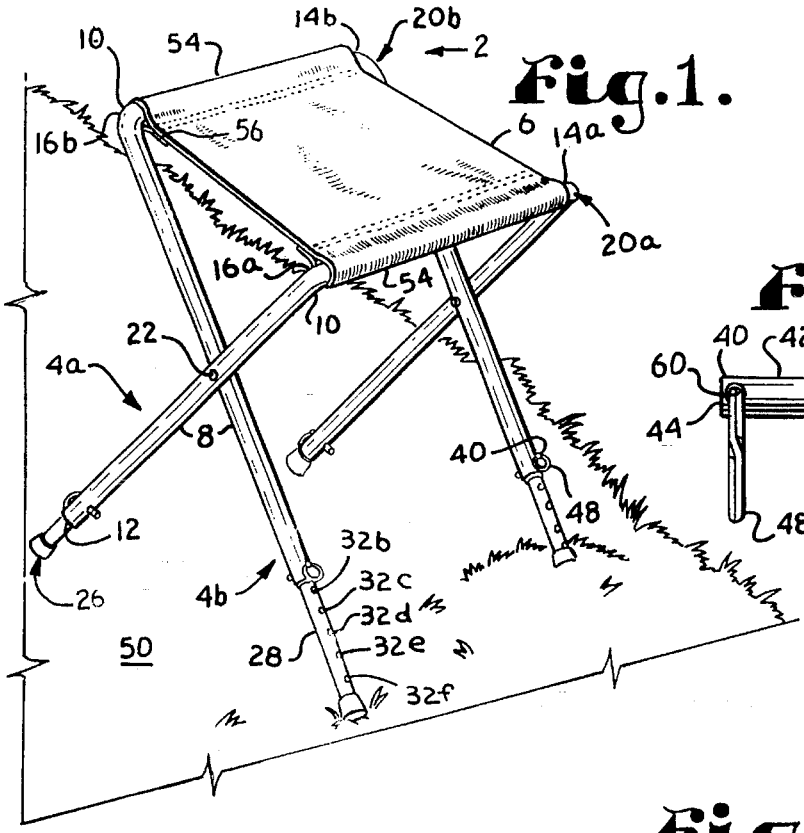
FIG. 1 is an upper, perspective view of a folding stool embodying the present invention.
Figure 4:
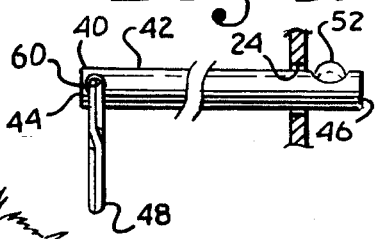
FIG. 4 is an enlarged, fragmentary, side elevational view of a locking pin thereof, with portions broken away to reveal internal construction.
Figure 2:
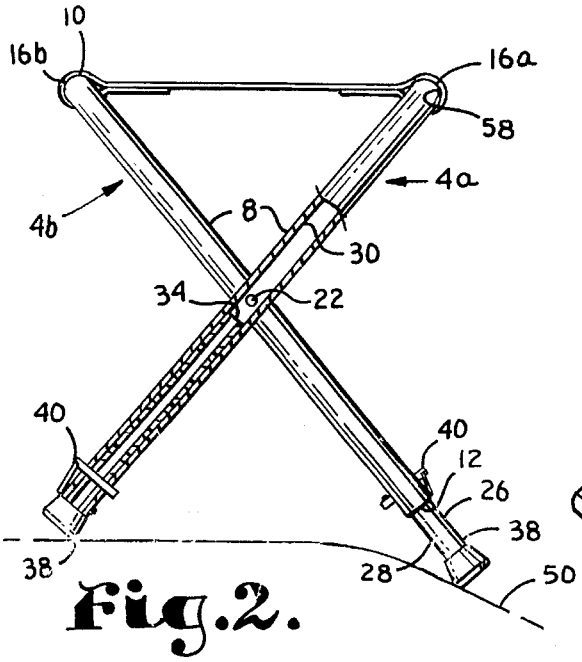
FIG. 2 is a side elevational view thereof, with portions broken away to reveal internal construction.
Figure 3:
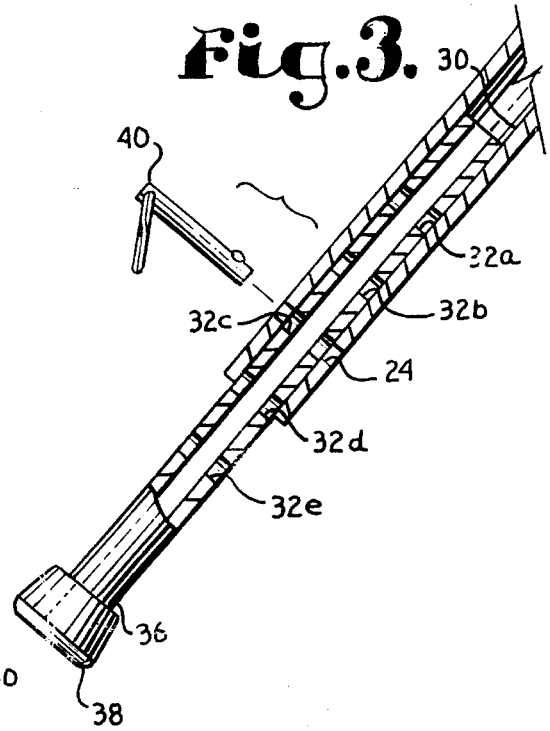
FIG. 3. is an enlarged, fragmentary, side elevational view thereof, with portions broken away to reveal internal construction.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a folding stool with extendable legs embodying the present invention. The folding stool 2 generally includes a pair of leg assemblies 4*a*, 4*b* and a seat 6.

II. Leg Assemblies 4*a*, 4*b*

Each leg assembly 4*a*, 4*b* includes a pair of leg members 8 with upper and lower ends 10, 12 respectively, and a crosspiece 14 with opposite ends 16*a*, 16*b* each connected to a respective leg member upper end 10. The leg members 8 and the crosspiece 14 can form a generally U-shaped configuration and can be formed of a suitable material, such as a length of hollow tubing or piping bent at approximately 90° angles at the intersections of the leg member upper ends 10 and the crosspiece ends 16*a*, 16*b*. The leg members 10 and the crosspiece 14 collectively form U-shaped leg base frames 20*a*, 20*b*. The leg base frames 20*a*, 20*b* are pivotally interconnected by respective fasteners 22 which extend through respective juxtaposed leg members 10*a*, 10*b* and form axles about which the leg base frames 20*a*, 20*b* pivot with respect to each other about a generally horizontal pivotal axis extending coaxially through and aligned with the fasteners 22. The crosspiece 14*a* is longer than the crosspiece 14*b* by about twice the thickness of the leg members 8 whereby the leg base frame 20*b* is adapted to fold inside of the leg base frame 20*a* when the stool 2 is folded to its folded or closed configuration (not shown). Each leg member 10 includes a lock pin receiver 24 located in proximity to its lower end 12.

A leg extension 26 is provided for each leg member 8 and comprises an extension member 28 having a generally tubular configuration with an outside diameter adapted to be telescopically received in bores 30 of the leg members 8. A plurality of extension member receivers 32*a*–*f* are located in longitudinally-spaced relation along the extension member 28 between upper and lower ends 34, 36 thereof. Each extension member lower end 36 mounts an extension member tip 38 which material can comprise a resilient material such as rubber, which can be chosen for its ability to protect a surface from the extension member lower ends 36 and to minimize slippage therebetween.

A plurality of locking pins 40 each comprising a shaft 42 with proximate and distal ends 44, 46 and a pull ring 48 mounted on the proximate end 44 are provided for selective placement in leg member receivers 24 and corresponding extension member receivers 32*a*–32*f*. The extension members 28 extend at various lengths from the respective leg members 8, which lengths correspond to respective extension member receivers 32*a*–32*f*. The leg assemblies 4*a*, 4*b* can thus be configured to accommodate various sloping ground surfaces 50 and provide relatively level crosspieces 14*a*, 14*b* which in turn provide a relatively level seat 6. It will be appreciated that the number and spacing of the extension member receivers 32*a*–32*f* can vary to achieve a desired degree of adjustability for the lengths of the leg assemblies 4*a*, 4*b*. Moreover, longer or shorter extension members 28 could be provided for interchangeable, telescopic mounting in the leg members 8.

Each locking pin 40 includes a retainer detent 52 which protrudes outwardly from the pin shaft 42 and is compressible to a retracted position within the shaft 42. The retainer detent 52, in its extended retaining position, retains the locking pin 40 within the respective receivers 24 and 28*a*–28*f*. In its retracted, compressed position, the retainer detent 52 permits passage of the shaft 42 through respective receivers 24 and 32*a*–32*f*, i.e., during insertion and removal of the locking pins 40.

III. Seat 6

The seat 6 preferably comprises a flexible material, such as nylon, canvas, leather, etc. and has opposite sides 54 whereat lap seams 56 are provided for forming crosspiece passages 58 each receiving a respective crosspiece 14*a* or 14*b*. The lap seams 56 can be formed by stitching or by some other suitable fastening means. With the folding stool 2 in its folded configuration (not shown), the seat 6 will be folded substantially double and depend downwardly in an area generally between the connected pairs of leg members 8. The stool 2 can thus be folded to a relatively compact, generally flat configuration.

The locking pin shaft proximate end 44 includes a pull ring receiver 60 which rotatably receives the pull ring 48. The pull ring 48 can comprise a split-ring, a D-ring, or other rings with suitable configurations.

It is to be understood that while certain forms of the present invention have been illustrated and described herein, it is not to be limited to the specific forms or arrangement of parts described and shown.

What is claimed and desired to be secured by Letters Patent is as follows:

1. A folding stool with independently length-adjusting legs, which comprises:

(a) a pair of leg assemblies each having:

(1) a pair of leg members with upper and lower ends;

(2) a crosspiece with opposite ends;

(3) each said leg member upper end being connected to a respective crosspiece end to form a leg base frame having a generally U-shaped configuration and being integrally formed of a single tubular member having a coaxial bore extending therethrough and open at said leg member lower ends, said leg base frame being bent at substantially right angles at the intersections of said leg member upper ends and said crosspiece ends;

(4) each said leg member having a pair of leg member locking pin receivers extending transversely therethrough in proximity to its lower end;

(5) a pair of independent leg extensions each having upper and lower ends and a plurality of leg extension locking pin receiver pairs extending transversely therethrough in longitudinally-spaced relation between said leg extension upper and lower ends;

(6) each said leg extension being independently slidably received in a respective leg member bore and independently length-adjustably extending from the lower end thereof with said leg member locking pin receiver pair aligned with a respective leg extension locking pin receiver pair;

(7) a plurality of locking pins each including a shaft with proximate and distal ends, a pull ring receiver in the proximate end thereof, a pull ring pivotally mounted in said pull ring receiver and a spring-biased ball detent mounted in the distal end thereof within a cavity in said locking pin distal end and with said ball detent protruding from the surface of said pin, said locking pin passing through and across said leg extension and said leg member within respective aligned pairs of said receivers in a locked position thereof, said locking pin shaft distal end being adapted to pass through said locking pin receivers; and (8) a pair of resilient tips each mounted on a respective leg extension lower end;

(b) one of said leg base frame having a narrower width than the other of said leg base frames whereby said leg members of said one leg base frame are at least partially positioned between said leg members of said other leg base frame;

(c) a pair of connecting axles each extending through a respective leg member of a respective leg base frame between the upper and lower ends thereof whereby said respective leg members are pivotally interconnected and adapted to pivot with respect to each other about a pivotal axis extending generally horizontally and in alignment with said connecting axles; and (d) a seat having opposite sides each doubled over to form a lap seam and a crosspiece passage receiving a respective crosspiece, said seat comprising a flexible material adapted to fold with said stool in a folded configuration thereof.

2. A folding stool, which comprises:

(a) a pair of leg assemblies each having:

(1) a pair of leg members each having upper and lower ends;

(2) a crosspiece connecting said leg member upper end;

(3) a pair of leg extensions each being telescopically interconnected to a respective leg lower end;

(4) leg length-adjusting means for mounting a respective leg extension on a respective leg member lower end in length-adjustable relationship; and (5) lock means for locking each said leg extension to a respective leg member in a fixed length relationship, said lock means comprising a plurality of locking pin receiver pairs in each said leg extension, a pair of locking pin receivers in each said leg member in proximity to the lower end thedreof, whereby said leg member locking pin receiver pair is aligned with said leg extension locking pin receiver pair in said fixed length relationship and a plurality of locking pins each including a shaft with proximate and distal ends, a pull ring receiver in the proximate end thereof, a pull ring pivotally mounted in said pull ring receiver and a spring-biased ball detent mounted in the distal end thereof within a cavity in said locking pin distal end and with said ball detent protruding from the surface of said pin, said locking pin passing through and across said leg extension and said leg member within respective aligned pairs of said receivers in a locked position thereof, said locking pin shaft distal end being adapted to pass through said locking pin receivers; and (b) one of said leg base frame having a narrower width than the other of said leg base frames whereby said leg members of said one leg base frame are at least partially positioned between said leg members of said other leg base frame;

(c) a pair of connecting axles each extending through a respective leg member of a respective leg base frame between the upper and lower ends thereof whereby said respective leg members are pivotally interconnected and adapted to pivot with respect to each other about a pivotal axis extending generally horizontally and in alignment with said connecting axles; and (d) a seat having opposite sides each doubled over to form a lap seam and a crosspiece passage receiving a respective crosspiece, said seat comprising a flexible material adapted to fold with said stool in a folded configuration thereof.

* * * * *